United States Patent [19]

Bailey

[11] 3,976,109

[45] Aug. 24, 1976

[54] DISPERSING METHOD AND APPARATUS FOR METERING THE DISPERSING OF DRY PARTICULATE MATERIAL INTO A LIQUID

[75] Inventor: James B. Bailey, Pleasantville, Pa.

[73] Assignee: Quaker State Oil Refining Corporation, Oil City, Pa.

[22] Filed: Dec. 18, 1974

[21] Appl. No.: 533,895

[52] U.S. Cl. ..... 141/9; 259/4 R

[51] Int. Cl.[2] ..... B65B 3/04

[58] Field of Search ..... 141/1–12; 259/4 R, 150, 180

[56] References Cited

UNITED STATES PATENTS

| | | | |
|---|---|---|---|
| 2,308,751 | 1/1943 | Guthrie et al. | 259/4 |
| 3,097,828 | 7/1963 | Grün | 259/4 |
| 3,164,443 | 1/1965 | Watson | 259/4 |

*Primary Examiner*—Houston S. Bell, Jr.
*Attorney, Agent, or Firm*—Francis A. Keegan

[57] ABSTRACT

A dispersing method and apparatus for metering the dispersing of dry particulate material into a liquid. The apparatus includes a supply container and a metering and dispersing assembly having a clog-preventer with a hub and a plurality of radially extending arms with a rim. Passages are formed between the arms for the passage of dry material. Any large agglomerates that may be formed from the dry material are supported by these arms above the passages to prevent clogging. A dispensing rod capable of vertical movement is positioned within a bore in the hub, and controls the vertical movement of the downwardly inclined dispersing surface attached to the lower end of the rod. The dispersing surface receives the particulate material from the bottom opening, and carries it substantially laterally from the bottom opening to be dispersed into the liquid. An alternate embodiment includes a liquid level control means to insure a proper liquid level in the dispersing container and a washing means to wet the walls of the container.

The method of dispersing the dry particulate material into a liquid includes providing a downwardly inclined surface below a supply container for the dry material, and having a bottom opening, selectively metering the materials through the opening and onto an inclined surface. The material is then permitted to move along the surface to the outside perimeter, and fall into the liquid below in a preselected pattern. Simultaneously the liquid is agitated below the falling material in a similar pattern to mix thoroughly the dry particulate material with the liquid.

33 Claims, 11 Drawing Figures

Fig-8
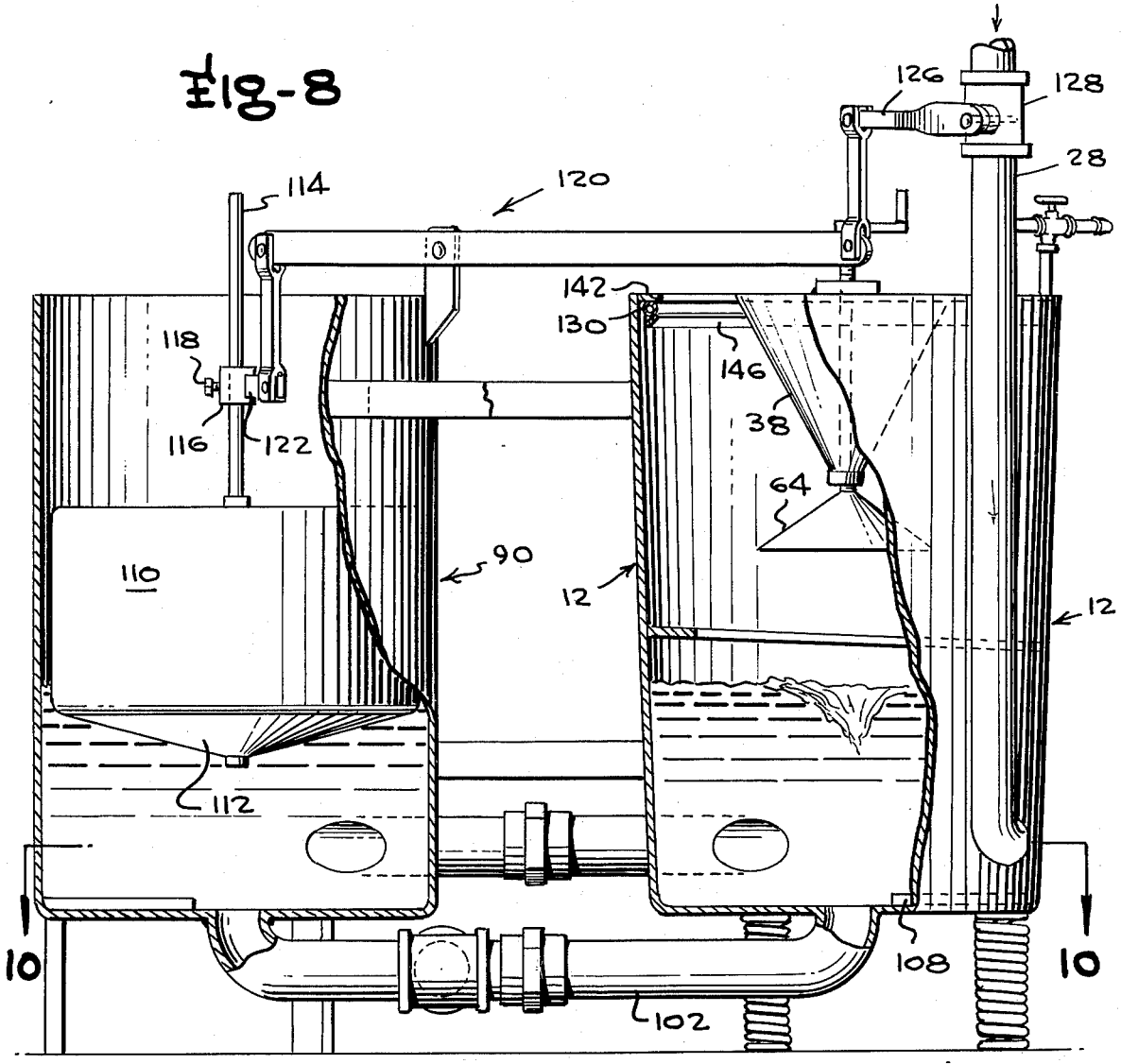
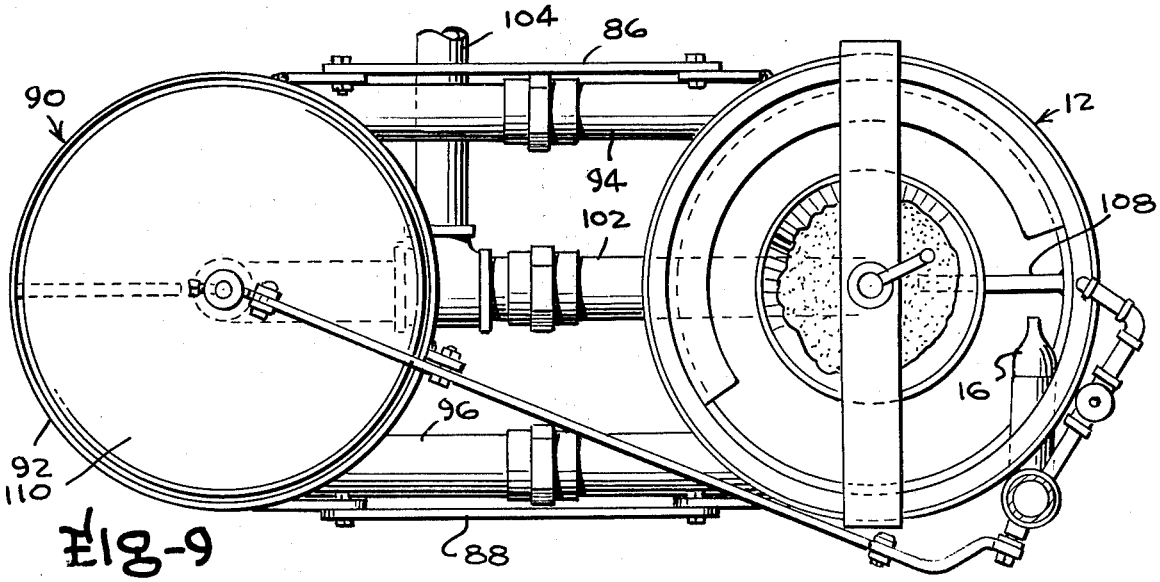
Fig-9

DISPERSING METHOD AND APPARATUS FOR METERING THE DISPERSING OF DRY PARTICULATE MATERIAL INTO A LIQUID

BACKGROUND OF THE INVENTION

1. Field of the Invention

The present invention relates generally to a method and apparatus for dispersing solids into liquids. More particularly, the present invention relates to a method and apparatus for metering the dispersal of dry particulate material into a liquid in order to form a thorough mixture.

2. Background of the Invention

There are numerous processes and apparatus utilizing the incorporation of solid particulate material into a liquid. The dry material may be in a very fine powder, or quite coarse, while the liquid may be water or some organic solvent, or even a slurry of solids. In general, techniques that have been utilized in the past attempted to rely principally upon agitation to effect the intimate mixture of the dry material and the liquid. While agitation can be effective to ultimately produce a dispersion of the dry powder, at high concentrations there is substantial difficulty in producing a proper dispersion.

Generally the prior art techniques do not adequately disperse the dry particulate material into the liquid prior to the application of any agitation to the liquid and dry material mix. The initial dispersion of the dry particulate material, both in the proper quantity and distributed in a uniform manner, is important to forming a proper mixture.

3. The Prior Art

In the Byrd U.S. Pat. No. 1,000,150, a generally similar dispensing device is illustrated, but such device is disclosed to be utilized for liquid dispensing, and also does not have a metering capability to distribute the material to be dispensed in a wide area. Also, such device is capable of clogging if used for dry material, due to the configuration of the valve closure, and the fact that the valve rod inherently moves laterally, to some degree, due to the bell crank operation at the rod's upper end.

SUMMARY OF THE INVENTION

The present invention constitutes a dispersing apparatus and method for metering the dispersing of dry particulate material into a liquid. The apparatus includes a supply container for the dry particulate material. A metering and dispensing assembly is positioned in the bottom opening of the container, and includes a clog-preventer, having a hub and a plurality of radially extending arms, as well as a rim secured to the container adjacent to the bottom opening. The arms are spaced around the hub, and form through-passages between the arms for passage of the dry material. The hub is provided with a bore that receives a dispensing rod disposed for vertical and adjustable movement. At the lower end of the rod a dispersing surface that is downwardly and outwardly inclined is positioned to receive the material passing through the passages between the arms. The dispersing surface carries the particulate material substantially laterally from the bottom opening to effect a substantially uniform dispersal of the material into the liquid. An alternate embodiment includes a liquid level control and a container wall wetting means.

The method of the present invention incorporates the use of a downwardly inclined surface below a supply container having a bottom opening, and containing the dry particulate material to be dispersed in the liquid below. The material is selectively metered through the opening and falls onto the inclined surface, where the material is permitted to move along the surface to the outside perimeter and drop into the liquid below in a preselected pattern. The liquid below is agitated to move the liquid along substantially the same pattern, whereby the dry particulate material and the liquid are thoroughly mixed.

OBJECTS OF THE INVENTION

The invention has as its principal object the provision of a method and apparatus for dispersing a dry particulate material into a liquid.

A further object of the present invention is to provide a method and apparatus for metering the dry particulate material onto a dispersing surface that moves the dry material substantially laterally to effect a proper dispersal.

Another object of the present invention is to provide a method and apparatus for preventing the clogging of the metering and dispersing assembly by the provision of radially extending arms that maintain any large agglomerate particles from clogging the passages.

A further object of this invention is the provision of a simple liquid level control and container wall wetting means in an apparatus for dispersing dry particulate material into a container of liquid.

THE DRAWINGS

These and other objects of the present invention will be more apparent upon careful study of the following description and drawings, in which:

FIG. 8 is a side elevational view partly broken away of the alternate embodiment of FIG. 7.

FIG. 9 is a plan view of the alternate embodiment of FIG. 7.

DESCRIPTION OF THE PREFERRED EMBODIMENT

Figure 1:
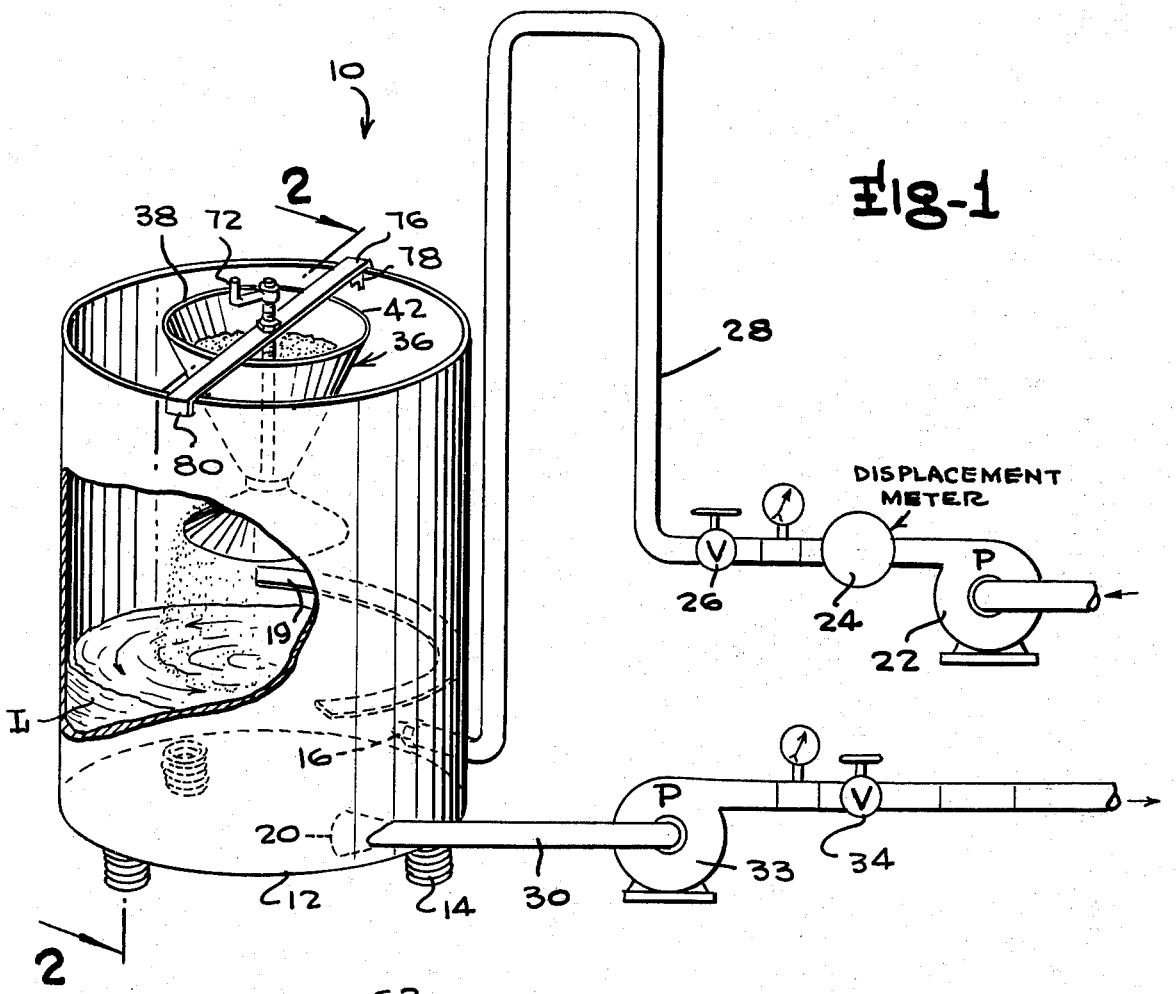
FIG. 1 is a perspective view partly broken away of the dispersing apparatus embodying the present invention.

In FIG. 1 there is depicted generally by the numeral 10 the dispersing apparatus system. The dispersing system includes a dispersing drum or tank 12, being supported by resilient legs 14 to permit vibration of the dispersing drum 12 and the liquid L contained in the drum.

Jet nozzle 16 is provided and positioned substantially tangential to the drum 12 to agitate the liquid L in a predetermined pattern indicated by arrows 18. Inclined splash guard 19 is provided on the side of the drum to retain the liquid within the drum. Mixed liquid composition containing the dry particulate material M may be withdrawn through outlet 20. The flow through the jet nozzle 16 is controlled by a displacement pump 22, to which displacement meter 24 and suitable valving 26 are secured along flowline 28. Similarly, on the outlet line 30 attached to outlet 20 there is incorporated displacement pump 32 and valve 34. The operation of either pump or the jet nozzle inherently vibrates the drum 12 due to its support upon the resilient legs 14.

To intimately mix the dry particulate material, which may be dry polymer material, into the water L the dispersing apparatus 36 is provided. The dispersing apparatus 36 is composed of a supply container 38 which as shown is conically shaped, but may have any other suitable shape provided that, at its lowest point, there is formed a bottom opening 40, and top opening 42. The supply container 38 may be formed from metal or other suitable material such as plastic and the like which would be sufficiently rigid and inert to support the volume of dry particulate material M for dispersing into the liquid L.

Figure 4:
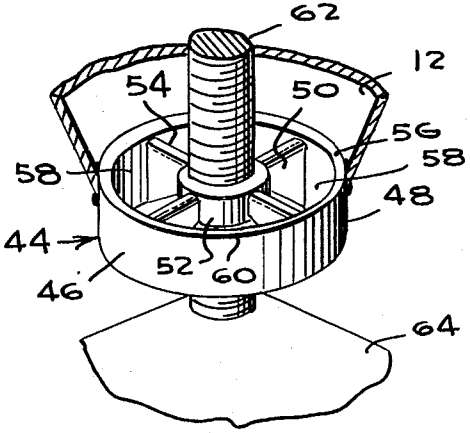
FIG. 4 is a perspective view partly broken away of the clog-preventer, preventing the large agglomerates of the dry particulate material from clogging the passages.
Figure 2:
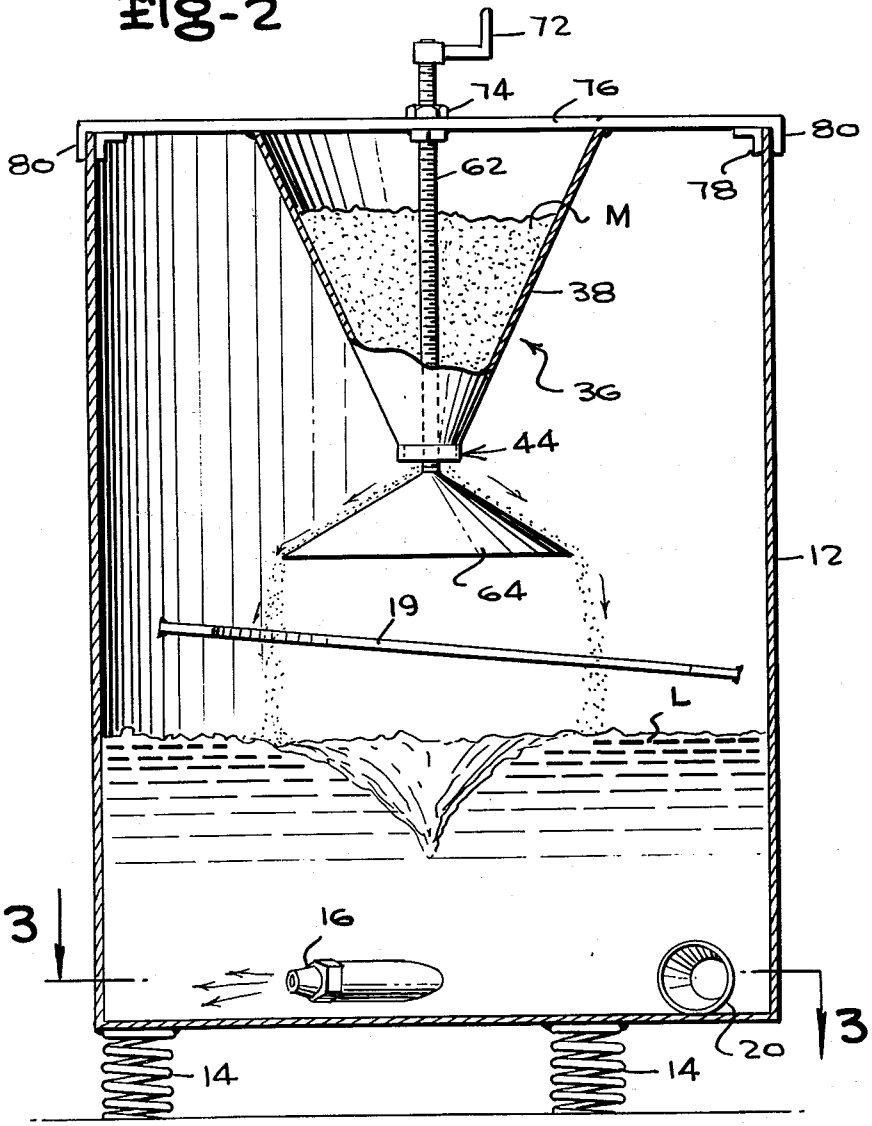
FIG. 2 is a cross-sectional side elevation view partly broken away of the dispersing apparatus, illustrating the lateral movement of the dry particulate material into a peripheral pattern.

Positioned within the bottom opening 40 is a metering and dispersing assembly 44, best shown in FIG. 4. The metering and dispersing assembly 44 includes a clog-preventer 46, formed with a rim 48 that is welded or otherwise secured to the mouth of the bottom opening 40. Radially extending from the rim 48 are arms 50 which are secured to a hub 52 at their outer end, and to the rim 48 at their outer end. The arms as shown include a smooth or rounded upper edge 54. The rim 48 is provided with an upper surface 56 which is beveled downwardly and inwardly so that in combination with the rounded edges 54 of the arms 50 the beveled upper surface of the rim 56 channels the dry material into the through passages 58 formed between the arms 50. The arms provide a clog-preventing function by retaining any large agglomerated particle of the dry particulate material from falling into the through passages 58 where they may be capable of clogging the passages. By retaining the large agglomerates above the arms 50 the inherent vibration produced by the operation of the jet nozzle and the connection with the flowlines to the pumps 22 and 32, the large agglomerated particles are maintained above the through passages and gradually are worn down into smaller individual grains, so as to fall through the through passages 58 without clogging.

The hub 52 includes a centrally positioned threaded bore 60 that is adapted to receive a feed-rate rod 62 extending vertically from below the bottom opening 40 to above the top opening 42 of the supply container 38. At the lower end of the rod 62 there is provided a dispersing surface 64, which may be in the form of an inverted cone. The underside of the clog-preventer 46 is designed to engage and conform to the incline of the dispersing surface 64.

Figure 5:
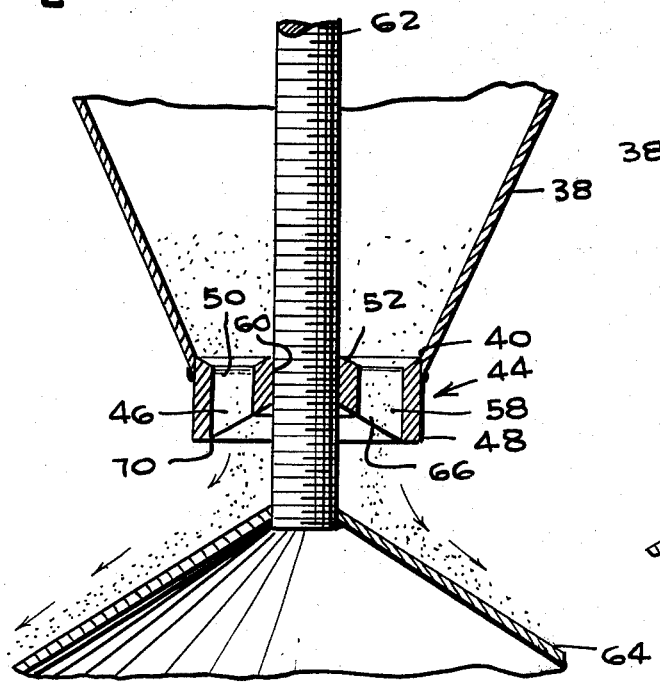
FIG. 5 is an elevation view in cross-section, partly broken away, of the dry particulate material passing through the metering and dispersing assembly in the open position, and falling upon the dispersing surface.
Figure 6:
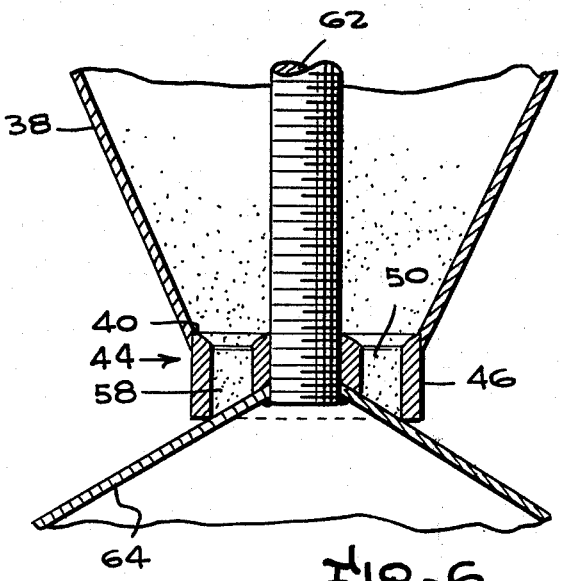
FIG. 6 is an elevation view in cross-section, partly broken away, similar to FIG. 5, except that the apparatus is illustrated in the closed position.
Figure 3:
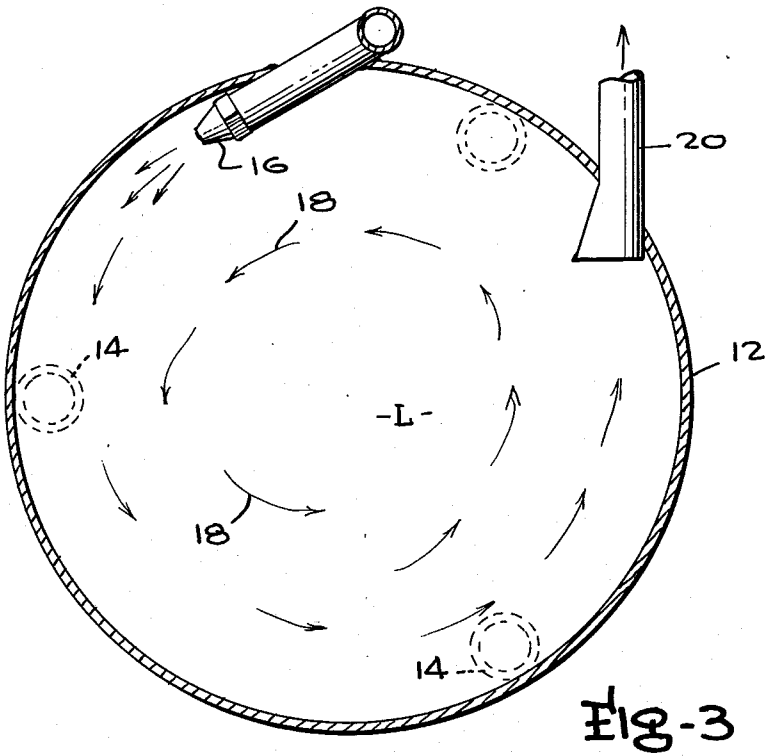
FIG. 3 is a view taken along lines 3—3 of FIG. 2 illustrating the tangential agitating force for the liquid.

As shown in FIGS. 5 and 6, the clog-preventer 46 is provided with upwardly and inwardly beveled undersurfaces 66 of the arms 50, being inclined precisely with the same gradient as the slope of the dispersing surface 64. The underside of the hub 52, as shown at 68, is similarly inclined as the under surface of the arms 66. The rim 48 is not beveled in order that the sharp edge 70, best shown in FIG. 6, will contact the dispersing surface 64 to create a sharp cutoff that will prevent the mashing of solid particulate material between the rim and the dispersing surface. The sharp edge 70 also provides a clean and precise cutoff upon contact with the dispersing surface.

The feed-rate rod 62 is designed for vertical movement through the hub to control and meter the amount of the dry material M that is permitted to pass through passages 58 and onto the dispersing surface 64. The raising and lowering of the rod 62 is achieved by the crank handle 72 secured to the upper end of the rod 62. The upper end of the rod is supported by threaded nuts 74 secured to support strap 76, which extends across the perimeter of the drum 12 and the supply container 38. The support strap 76 is provided with inner and outer alignment rims 78 and 80, as shown, to retain the strap in proper position.

In operation, the dispersing apparatus of the present invention permits the dispersing surface 64 to be raised and lowered by the crank handle 72 into and out of closed position with the mating surface of the underside of the metering and dispensing assembly 44 to permit the desired amount of dry material M to proceed into and out of the through passages 58. The material M flows easily due to the vibratory agitation enhanced by the resilient legs 14, the pumps and jet nozzle 16. The closer that the dispersing surface 64 comes to the inclined under surface of the metering and dispersing assembly by operation of crank 72, the less of the particulate material that falls through the passages 58. The large agglomerates are held in position on top of the arms 50 in order to prevent clogging of the passages and all material that falls onto the dispersing surfaces are carried laterally outwardly at least twice the diameter of the bottom opening.

The particulate material falls from the dispersing surface in a preselected pattern at a substantial lateral distance from the bottom opening. The pattern of the falling dry particulate material as it reached the liquid L is uniform and generally circular. Prior to the release of the material M, the jet nozzle 16 is operated through pump 22 to pump the liquid, which usually would be water, into the drum 12 to conform to the circular pattern of the dry material falling from the dispersing surface 64. The tangential flow of the liquid from the nozzle 16 agitates the liquid L to form an intimate mixture with the falling pattern of the dry material, and results in a uniform mixture of the dry material and the liquid.

FIGS. 7 through 11 illustrate an alternate embodiment of the apparatus of the present invention wherein like parts are given the same numeral designation as previously described. The drum 12 of this alternate embodiment in which the dispensing of the dry particulate material is to be made is provided with tapering sides 82, that taper downwardly and inwardly towards the bottom 84 of the drum. Secured to the drum 12 by suitable supporting rods 86 and 88 is a similar tank 90 having essentially the same dimensions as the drum except that the sides 92 of the tank do not taper. The tank 90 and the drum 12 are in fluid communication by means of suitable connecting pipes 94 and 96 which are essentially horizontal and adjacent the bottom of both the tank 90 and the drum 12 as may be best seen in FIG. 10. The drum 12 and the tank 90 are also in fluid communication through their respective bottom openings 98 and 100 to which is connected the common bottom pipe 102. This pipe 102 fluidly communicates with outlet pipe 104 that leads to pump 32 not shown in FIGS. 7 – 11. Tank 90 and drum 12 are also provided at their bottoms with flow directors 106 and 108 to maintain a level liquid surface.

In order to control the liquid level in the drum 12, liquid level control means is provided in the tank 90. The liquid levels in the drum and tank will be the same due to the multiple fluid connections between the two. The tank 90 is provided with a float 110 having a tapered bottom 112. The float is approximately the same diameter as the drum into which it is positioned. A vertical rod 114 is secured to the top of the float to which is releasably secured a slidable collar 116 having screw securing means 118 holding the collar in any vertical position along the rod 114. A series of connecting rods and pivoting links 120 are provided which are secured to the extension arm 122 at one end that is rigidly held to the column 116 while pivoting about pivot point 124 and extending at the other end to raise and lower valve control rod 126. The valve control rod 126 operates a conventional butterfly or globe type valve 128 which controls the flow of liquid through flow line 28 and jet nozzle 16 into the drum 12. It can readily be seen that the level of the float 110 as it lowers will operate to open the valve 128 to admit additional liquid and upon the float reaching a preselected vertical position will shut off the flow or at least substantially limit the flow of liquid to the valve 128. In this manner, the liquid level in drum 12 may be kept constant or within predetermined levels.

Figure 7:
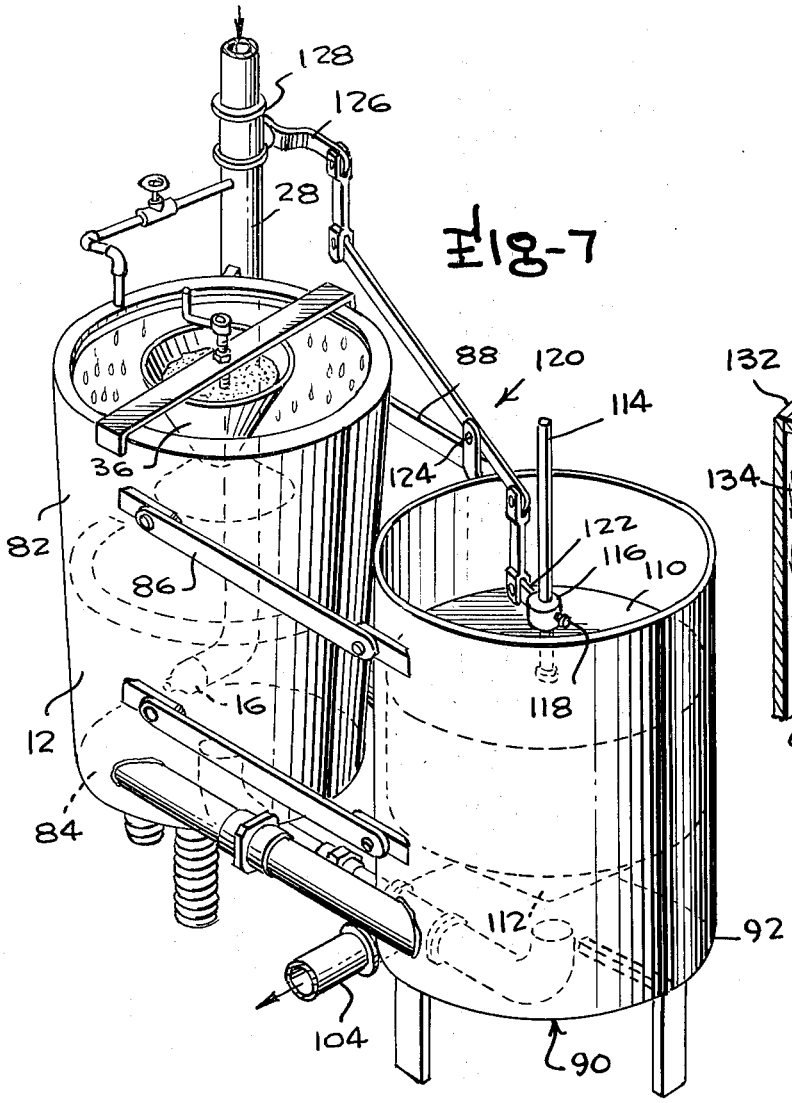
FIG. 7 is a perspective view of an alternate embodiment illustrating the liquid level control means and the container wall wetting means.
Figure 11:
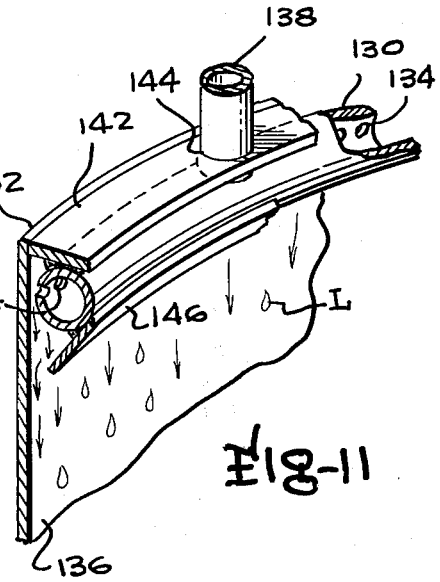
FIG. 11 is an enlarged cross-sectional view in perspective and partly broken away illustrating the container wall wetting means.
Figure 10:
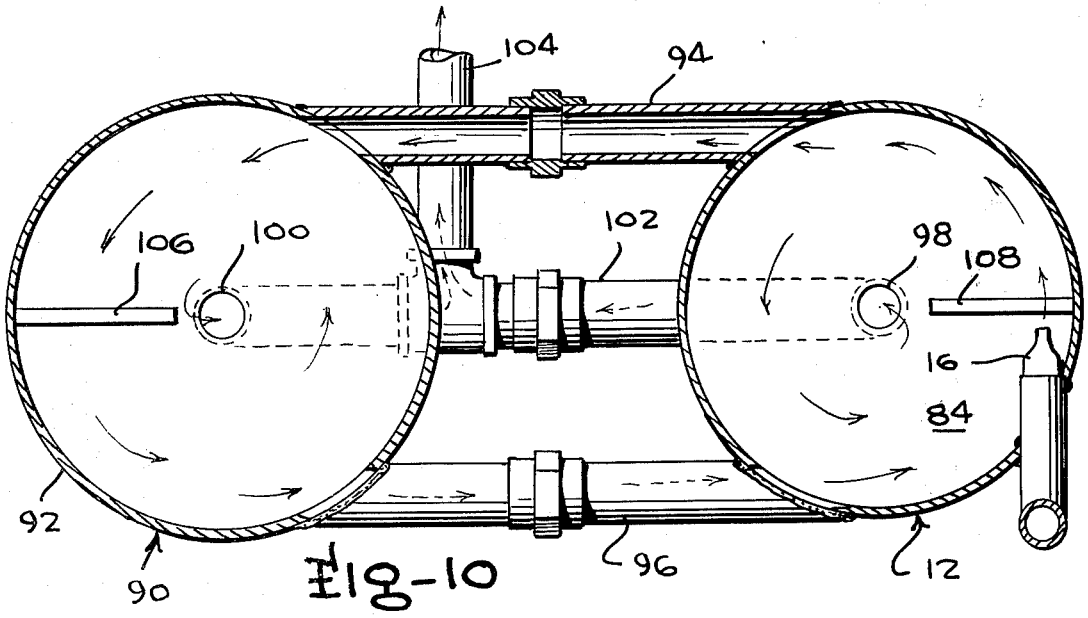
FIG. 10 is a cross-sectional view taken along lines 10—10 of FIG. 8.

As best shown in FIGS. 7 and 11, the drum 12 is provided with a perforated ring 130 surrounding the top rim 132 of the drum 12. The perforated ring is provided with a plurality of openings 134 which face towards the inside wall surface 136 of the drum. Feed pipe 138 communicates with the perforated ring 130 to supply liquid from the flow line 28. Gate valve 140 or other suitable valve means controls the liquid flow from the feed pipe into the perforated ring 130. The perforated ring 130 is held in place by lateral rim 142 which is secured to the top rim 132 in any suitable manner. The perforated rim may be welded to the lateral rim which is provided with opening 144 to receive the feed pipe 138. On the underside of the perforated ring 130, flow director 146 is suitably secured and extends at an angle below the perforated ring throughout its entire extent around the top rim of the tank. The flow director is spaced from the inside wall surface 136 to permit the flow of liquid L to flow down the inside wall surface 136 and wash any of the very small dry particulate material that may be of dust particle size down into the homogeneous mixture below. The wall wetting or washing means described prevents the tendency of the dry particulate materials from clinging to the side wall surface and build up on the wall to be lost to the dispersion until they otherwise fall in large lumps. As will be noted in this embodiment, the tapering sides 82 contribute to the effectiveness of the washing of the dry particulate material into the homogeneous mixture below.

The foregoing description demonstrates clearly and effectively the attainment of each of the objects of the present invention as encompassed by the appended claims.

I claim:

1. A dispersing apparatus for metering the dispersing of dry particulate material into a liquid comprising:

a liquid supply means, a supply container for said dry particulate material having a top opening and a bottom opening communicating with said liquid supply means, a metering and dispersing assembly positioned in said bottom opening, said assembly including a clog-preventer having a hub, a plurality of radially extending arms and a rim secured to said container adjacent said bottom opening, said arms being spaced around said hub and forming through passages between said arms, a bore positioned within said hub, a dispensing rod disposed within said bore for vertical movement through said bore, adjustment means at the upper end of said rod for adjustably moving said rod vertically, a dispersing surface secured to the end of said rod for selective movement with said rod, toward and away from said clog-preventer, to meter the flow into said liquid supply means of said dry particulate material in said container and to carry said material substantially laterally from said bottom opening for substantially uniform dispersal.

2. The apparatus of claim 1, including means secured to the upper end of said rod for vertically supporting said rod.

3. The apparatus of claim 1, including said clog-preventer having an underside provided with a sloping surface corresponding to said dispensing surface.

4. The apparatus of claim 3, including said clog-preventer being downwardly and outwardly directed.

5. The apparatus of claim 1, including said arms extending laterally into contact with said rim to support large agglomerated particles of said material above said through passages between said arms.

6. The apparatus of claim 3, including said underside including said arms and said hub, being sloped downwardly and outwardly.

7. The apparatus of claim 1, including means secured to the upper end of said rod for vertically supporting said rod, and said clog-preventer having an underside provided with a sloping surface corresponding to said dispensing surface.

8. The apparatus of claim 1, including means secured to the upper end of said rod for vertically supporting said rod, said clog-preventer having an underside provided with a sloping surface corresponding to said dispensing surface, and said clog-preventer being downwardly and outwardly directed.

9. The apparatus of claim 1, including means secured to the upper end of said rod for vertically supporting said rod, said clog-preventer having an underside provided with a sloping surface corresponding to said dispensing surface, said clog-preventer being downwardly and outwardly directed, and said arms extending laterally into contact with said rim to support large agglomerated particles of said material above said through passages between said arms.

10. The apparatus of claim 1, including said clog-preventer having an underside provided with a sloping surface corresponding to said dispensing surface, and said arms extending laterally into contact with said rim to support large agglomerated particles of said material above said through passages between said arms.

11. A method of dispersing dry particulate material into a container of liquid comprising:

providing a downwardly inclined surface below a supply container having a bottom opening and containing said material, selectively metering the material through said opening and onto said inclined surface, permitting said material to move along said surface to the outside perimeter thereof and fall into the container of liquid, in a preselected pattern, agitating said liquid to move substantially along said pattern whereby to mix said dry particulate material with said liquid.

12. The method of claim 11 including agitating said liquid by tangentially directing jets of liquid into said liquid.

13. The method of claim 11, including motivating the dry material through said bottom opening by vibrating said supply container.

14. The method of claim 11, including agitating said liquid by tangentially directing jets of liquid into said liquid, and motivating the dry material through said bottom opening by vibrating said supply container.

15. The method of claim 11, including metering the amount of dry material deposited by vertically moving said inclined surface toward and away from said bottom opening.

16. The method of claim 11, including agitating said liquid by tangentially directing jets of liquid into said liquid, motivating the dry material through said bottom opening by vibrating said supply container, and metering the amount of dry material deposited by vertically moving said inclined surface toward and away from said bottom opening.

17. The method of claim 11, including wetting the surface of the container for said liquid and continually washing dry particulate material down the sides of said container for the liquid.

18. The method of claim 11, including providing liquid in a tank adjacent to a container for said liquid and continuously sensing the liquid level in said tank, controlling the level of the liquid in said tank in accordance with the liquid level sensed.

19. The apparatus of claim 1, including means for continually wetting the inside surface of said container for the liquid.

20. The apparatus of claim 19, including said wetting means comprising a perforated ring positioned around the periphery of said container for the liquid and means supplying liquid to be dispensed from said ring.

21. The apparatus of claim 1, including liquid level control means automatically controlling the level of liquid in the container for the liquid.

22. The apparatus of claim 19, including the vertical sides of said supply container being tapered downwardly and inwardly.

23. The apparatus of claim 21, including a liquid level detection tank in fluid communication with said container for the liquid and operably connected to said liquid level control means.

24. The apparatus of claim 1, including means for continually wetting the inside surface of said container for the liquid, wetting means comprising a perforated ring positioned around the periphery of said container for the liquid and means supplying liquid to be dispensed from said ring, liquid level control means automatically controlling the level of liquid in the container for the liquid.

25. The apparatus of claim 24, including the vertical sides of said supply container being tapered downwardly and inwardly, a liquid level detection tank in fluid communication with said container for the liquid and operably connected to said liquid level control means.

26. The apparatus of claim 20, including liquid level control means automatically controlling the level of liquid in the container, the vertical sides of said container being tapered downwardly and inwardly, a liquid level detection tank in fluid communication with said container and operably connected to said liquid level control means.

27. The apparatus of claim 26, including means secured to the upper end of said rod for vertically supporting said rod, said clog-preventer having an underside provided with a sloping surface corresponding to said dispensing surface, said clog-preventer being downwardly and outwardly directed, and said arms extending laterally into contact with said rim to support large agglomerated particles of said material above said through passages between said arms.

28. The apparatus of claim 27, including said clog-preventer having an underside provided with a sloping surface corresponding to said dispensing surface, and said arms extending laterally into contact with said rim to support large agglomerated particles of said material above said through passages between said arms.

29. A dispersing apparatus for metering the dispersing of dry particulate material into a liquid comprising:

a liquid supply means, a supply container for said dry particulate material having a top opening and a bottom opening communicating with said liquid supply means, a metering and dispersing assembly positioned in said bottom opening, said assembly including a clog-preventer means having passages there through for said dry particulate material, a dispersing surface positioned below said clog-preventer and adapted to open and close said passages, movement control means secured to said dispersing surface for vertically moving said dispersing surface into and out of engagement with said clog-preventer to open and close said passages, guide means included on said clog-preventer to maintain said dispersing surface operable for engagement with said clog-preventer, said movement control means being operable to move said dispersing surface into and out of engagement with said clog-preventer to open and close said passages whereby to meter the flow of said dry particulate material in said container into said liquid supply means and to carry said materials substantially laterally from said bottom opening for substantially uniform dispersal.

30. The apparatus of claim 29 including, said clog-preventer having a plurality of radially extending arms and a rim secured to said container adjacent said bottom opening, and said arms being spaced to form said passages between said arms.

31. The apparatus of claim 30 including, said guide means being a hub to which said arms are connected.

32. The apparatus of claim 31 including, a rod forming said movement control means, said rod being received in said hub for vertical movement therein.

33. The apparatus of claim 32 including adjustment means at the upper end of said rod for moving said rod vertically.

* * * * *